US008921728B2

(12) United States Patent
Lang et al.

(10) Patent No.: US 8,921,728 B2
(45) Date of Patent: Dec. 30, 2014

(54) SWITCH UNIT WITH ARC-EXTINGUISHING UNITS

(75) Inventors: Volker Lang, Bonn (DE); Lutz Friedrichsen, Cologne (DE)

(73) Assignee: Eaton Electrical IP GmbH & Co. KG, Schoenefeld (DE)

( * ) Notice: Subject to any disclaimer, the term of this patent is extended or adjusted under 35 U.S.C. 154(b) by 223 days.

(21) Appl. No.: 13/702,374

(22) PCT Filed: Jun. 7, 2011

(86) PCT No.: PCT/EP2011/059338

§ 371 (c)(1),
(2), (4) Date: Feb. 26, 2013

(87) PCT Pub. No.: WO2011/154380

PCT Pub. Date: Dec. 15, 2011

(65) Prior Publication Data

US 2013/0206729 A1 Aug. 15, 2013

(30) Foreign Application Priority Data

Jun. 7, 2010 (EP) ..... 10165139

(51) Int. Cl.

| | |
|---|---|
| ***H01H 9/44*** | (2006.01) |
| ***H01H 33/20*** | (2006.01) |
| ***H01H 9/34*** | (2006.01) |
| ***H01H 77/10*** | (2006.01) |
| *H01H 1/20* | (2006.01) |

(52) U.S. Cl.

CPC ..... *H01H 33/20* (2013.01); *H01H 9/341* (2013.01); *H01H 77/10* (2013.01); *H01H 1/20* (2013.01)

USPC ..... 218/22; 218/33; 218/154; 335/16

(58) Field of Classification Search

USPC ..... 218/22–23, 33, 154; 335/16

See application file for complete search history.

(56) References Cited

U.S. PATENT DOCUMENTS 2,337,949 A 12/1943 Walle
3,764,946 A * 10/1973 Mostosi ..... 335/195

(Continued)

FOREIGN PATENT DOCUMENTS

DE 202005007878 U1 9/2006
EP 1884969 A2 2/2008

(Continued)

OTHER PUBLICATIONS

European Patent Office, International Search Report in International Patent Application No. PCT/EP2011/059338 (Jul. 18, 2011).

*Primary Examiner* — Truc Nguyen

(74) *Attorney, Agent, or Firm* — Leydig, Voit & Mayer, Ltd.

(57) ABSTRACT

A switch suitable for DC applications includes: two fixed conductive contacts with first contact areas; a movable conductive bridge with two second contact areas for being connected to the two first contact areas in the on-status and for being disconnected from the two the first contact areas in the off-status; and two arc-extinguishing units configured to extinguish electric arcs occurring between the first and second contact areas after disconnecting the second contact areas from the first contact areas. First conductive arc-guiding elements extend from each first contact area into the corresponding arc-extinguishing unit and at least one second conductive arc-guiding element extends into the arc-extinguishing units suitably shaped to guide the electric arcs from each of the second contact areas of the movable bridge into the arc-extinguishing units.

19 Claims, 3 Drawing Sheets

(56) References Cited

U.S. PATENT DOCUMENTS

| | | | | | |
|---|---|---|---|---|---|
| 3,815,059 | A | * | 6/1974 | Spoelman | 335/16 |
| 4,375,021 | A | | 2/1983 | Pardini et al. | |
| 4,408,173 | A | * | 10/1983 | Adlerteg et al. | 335/16 |
| 4,451,718 | A | * | 5/1984 | Yamagata et al. | 218/23 |
| 4,849,590 | A | * | 7/1989 | Becker et al. | 218/33 |
| 4,970,482 | A | | 11/1990 | Jacobs et al. | |
| 5,138,122 | A | * | 8/1992 | Moldovan et al. | 218/22 |
| 6,373,016 | B2 | * | 4/2002 | Brouillat et al. | 218/154 |
| 6,590,173 | B2 | * | 7/2003 | Uchida et al. | 200/244 |
| 7,417,520 | B2 | | 8/2008 | Kralik | |
| 7,902,948 | B2 | | 3/2011 | Lueders | |
| 7,915,985 | B2 | | 3/2011 | Schmitz et al. | |
| 2010/0059481 | A1 | | 3/2010 | Kraetzschmar | |

FOREIGN PATENT DOCUMENTS

| | | | |
|---|---|---|---|
| EP | 2061053 | A2 | 5/2009 |
| EP | 2079088 | A2 | 7/2009 |
| WO | 2008087136 | A1 | 7/2008 |

* cited by examiner

SWITCH UNIT WITH ARC-EXTINGUISHING UNITS

CROSS-REFERENCE TO RELATED APPLICATIONS

This patent application is a national stage entry under 35 U.S.C. §371 of International Application No. PCT/EP2011/059338, filed Jun. 7, 2011, and claims priority to European Patent Application No. EP 10165139.6, filed Jun. 7, 2010. The International Application was published in English on Dec. 15, 2011 as WO 2011/154380 A1.

FIELD

The invention relates to a switch unit with arc-extinguishing units providing a quick and reliable extinguishing of an electric arc if present inside the switch.

BACKGROUND

Electrical switches are able to provide an electrical conductive path in a closed status (on-status) of the switch. To interrupt the flowing current, the switch is opened (off-status) . Therefore switching is connecting or disconnecting two contacts. In case of disconnecting the contacts from each other, current flows through the connection until the connection is opened. When an inductive circuit commonly operated in air is switched off the current cannot instantaneously jump to zero; a transient arc will be formed across the separating contacts. An electric arc is an electrical breakdown of a gas which produces an ongoing plasma discharge, resulting from a current flowing through normally nonconductive media such as air. Electric arcs in switches operated with AC power will extinguish at latest at the zero point of the AC voltage. In contrast to AC applications, the occurrence and the stability of electric arcs is much higher in switches operated with DC power. Undesired or unintended electric arcing can have detrimental effects on electronic equipment such as switches. If a circuit has enough current and voltage (commonly more than 1 A and more than 50V), the electric arc will not extinguish on its own. Such a permanent arc will damage the contact points (erosion of the contacts) inside the switch. Additionally there is a risk that electric arcs may reach the outside of a switch causing damage to equipment such as melting of conductors, destruction of insulation, and fire causing a hazard to people and equipment. Therefore especially DC switches are normally designed to contain and to extinguish an arc in so-called arc-extinguishing units inside the switch.

Document EP 1884969 discloses a contactor with two fixed contacts and a contact bridge to connect the fixed contacts as a special example of a switch suitable for DC current with an arc-extinguishing chamber to extinguish arcs occurring during opening of the contact points to interrupt the current flowing through the contact points. The contactor comprises a combination of permanent magnets and electromagnets to guide an electronic arc from the contact points to an arc-guiding plate separated from the contact points via an air gap, where the permanent magnets are intended to force the electric arc jumping across the air gap, which is a barrier for the electric arc on its way to the extinguishing chamber. The electromagnets are connected to arc-guiding plates and the fixed contacts to drive the electric arc towards the arc-extinguishing chamber along the arc-guiding plate. The driving magnetic field provided by the electromagnets depends on the current flowing through the electromagnets, which depends on the properties of the electric arc, which may vary. It is desirable to obtain a switch with the smallest number of required parts. It is further desired to obtain a switch, where the electric arc can be extinguished as fast as possible under predictable and stable conditions.

Document EP 2 061 053 A2 discloses a switchgear having a housing with two side panels opposite to each other. Three holding areas are provided for conducting paths parallel to each other. The holding areas are arranged next to one another in the housing between the two side panels. The conducting paths are associated with assigned arc-unloading devices that are arranged in the housing between the two side panels. An alternatively configured switching device for direct-current applications in which the external magnets are magnetically coupled via magnetic return elements is disclosed, wherein the magnetic return elements are additional separate constructions, which are installed only with switches for direct-current applications.

SUMMARY

In an embodiment, the present invention provides a switch suitable for DC applications. The switch includes: two fixed conductive contacts with first contact areas; a movable conductive bridge with two second contact areas for being connected to the two first contact areas in the on-status and for being disconnected from the two the first contact areas in the off-status; and two arc-extinguishing units configured to extinguish electric arcs occurring between the first and second contact areas after disconnecting the second contact areas from the first contact areas. First conductive arc-guiding elements extend from each first contact area into the corresponding arc-extinguishing unit and at least one second conductive arc-guiding element extends into the arc-extinguishing units suitably shaped to guide the electric arcs from each of the second contact areas of the movable bridge into the arc-extinguishing units. At least two permanent magnets are suitably arranged adjacent to the first and second contact areas to provide a magnetic field suitable to support the guiding of the electric arc into the arc-extinguishing units. At least parts of the second arc-guiding element are made of a magnetic permeable material, which are connected to the permanent magnets as a back iron for the permanent magnets to increase the strength of the magnetic field between the permanent magnets.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
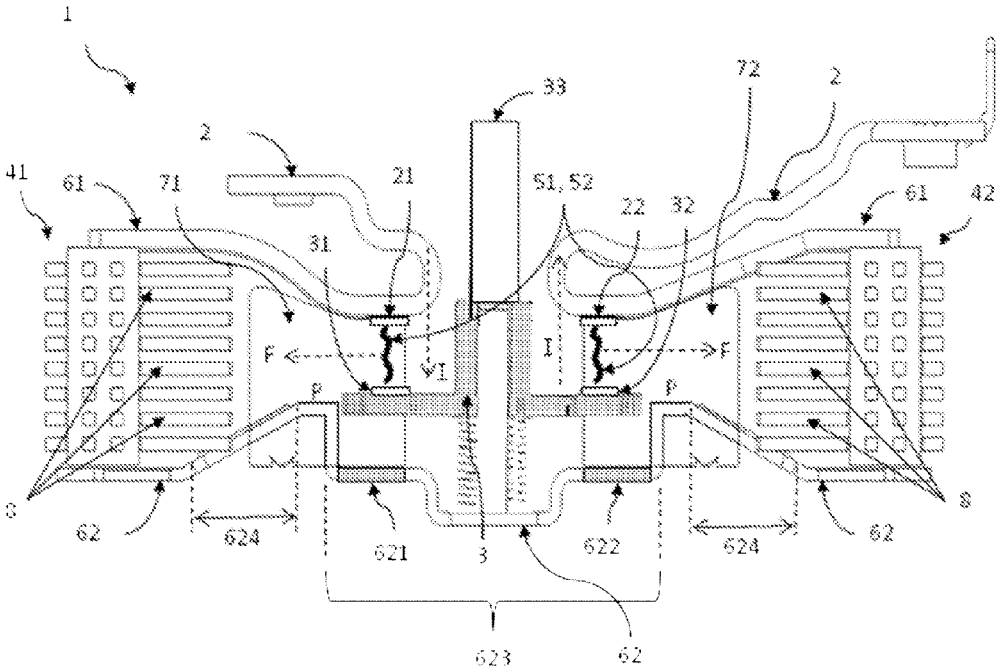
FIG. 1: an embodiment of the switch according to the present invention in a side view.

In an embodiment, the present invention provides a simple switch suitable for DC applications, where occurring electric arcs are extinguished in a fast, reliable and predictable manner In an embodiment, the present invention provides a switch suitable for DC applications comprising two fixed conductive contacts with first contact areas, a movable conductive bridge with two second contact areas for being connected to the two first contact areas in the on-status and for being disconnected from the two the first contact areas in the off-status and two arc-extinguishing units to extinguish electric arcs occurring between the first and second contact areas after disconnecting the second contact areas from the first contact areas, wherein a first conductive arc-guiding element extends from each first contact area into the corresponding arc-extinguishing unit and at least one second conductive arc-guiding element extending into the arc-extinguishing units suitably shaped to guide the electric arcs from each of the second contact areas of the movable bridge into the arc-extinguishing units, wherein at least two permanent magnets are suitably arranged adjacent to the first and second contact areas to provide a magnetic field suitable to support the guiding of the electric arc into the arc-extinguishing units, wherein at least parts of the second arc-guiding element are made of a magnetic permeable material, which are connected to the permanent magnets as a back iron for the permanent magnets to increase the strength of the magnetic field between the permanent magnets.

A switch according to the present invention may be any switch comprising two fixed conductive contacts to be connected via a movable conductive bridge. Examples of such a switch are contactors, disconnectors, high-current switches or circuit-breakers. The switch shall be suitable for DC application, but may be also applicable for AC applications. The first and second contact areas denote the areas of the first fixed contacts and the movable bridge, which are in direct contact, when the switch is closed. In the closed status, current flows through the switch from one first contact to the other first contact (also denoted as on-status). The term "conductive" denotes the electrical conductivity of the corresponding components. The term "conductive bridge" denotes any kind of component, which is suitable to electrically connect the two first contact areas, which are separated, via the conductive material of the bridge, which at least establish a sufficient conductive path between the two second contact areas on the surface of the bridge facing towards the two first contact areas. The bridge is moved towards the first contacts to close the switch and is moved away from the first contact areas to open the switch in order to interrupt the current flow through the switch from one first contact to the other first contact (also denoted as off-status). This movement can be triggered manually or with an electrical switching power, which can be much lower than the power provided by the switch to connected devices. The contact areas may have any suitable shape. The contact areas may have any shape varying between an extending two-dimensional area and a very small point-like area. The material of fixed contacts, contact areas and the bridge may by any suitable electrically conductive material.

The arc-extinguishing unit may be any suitable unit to extinguish an electrical arc guided into this arc-extinguishing unit. In an embodiment the arc-extinguishing units comprise multiple arc-splitters between the first and second arc-guiding elements arranged parallel to each other, where the permanent magnets extend close to the arc-splitters. The term "close" denotes a distance in the order of one or a few millimeters. Here the Lorenz force will be applied to the electric arc until the arc enters the arc-extinguishing units further decreasing the time for extinguishing the electric arc. If the available volume inside the switch is sufficient, it is preferred to extend the permanent magnets closer to the arc-extinguishing units or even inside the arc-extinguishing units. The arc-splitters may be v-shaped. The electric arc will be divided into several sub-arcs present between the adjacent arc-splitters. Therefore the required voltage to maintain an electric arc through all the arc-splitters increases by the factor of the number of present arc-splitter resulting in a breakdown voltage larger than the original voltage leading to an extinguished arc. The arc-splitters are mounted in an insulating material also holding the first and second arc-guiding elements. The arc-guiding elements (first and second) may have any suitable shape to guide an arc towards the arc-extinguishing unit. The arc-guiding elements may by plates with a three-dimensional contour. In an embodiment, the thickness or width of the arc-guiding elements may vary. The distance between the first and second arc-guiding elements may increase with increasing distance to the first and second contact areas.

The electric arc is driven towards the arc-extinguishing unit by the magnetic field provided by the permanent magnets arranged near (adjacent) to the first and second contact areas on opposite sides of the first and second contact areas. A permanent magnet is an object made from a material that is magnetized and creates its own persistent magnetic field. As an example permanent magnets may comprise Fe, Ni, Co or alloys comprising Fe, Co, Ni having a large coercive force providing a strong and stable magnetic field. The permanent magnets are arranged in a manner providing an essentially homogeneous magnetic field between the oppositely arranged permanent magnets in a volume at least around the first and second contact areas in an open status of the switch where the direction of the magnetic field is suitable to apply a Lorenz force to the electric arc forcing the arc to move towards the arc-extinguishing units. The required time to drive the electric arc into the arc-extinguishing unit depends on the strength, the homogeneity and the direction of the magnetic field relative to the desired direction into which the arc shall be driven and the direction of the current flow within the electric arc. The direction of the current within the electric arc is defined by the installation of the switch. Secondly the arc-extinguishing units are preferably arranged in a direction perpendicular to the direction of the current flow within the electric arc established between the contact areas to enable a maximum magnetic force to the electric arc. Thirdly the permanent magnets are preferably arranged in a manner to provide a magnetic field perpendicular to the current flow and to the desired driving direction for the electric arc having the required orientation to drive the arc into the arc-extinguishing units. Therefore the permanent magnets are preferably shaped as elements extending essentially parallel to the moving plane of the movable bridge, and preferably the permanent magnets are shaped as thin plates. The available space inside a switch is limited; therefore thin plates occupying only a small volume are advantageous. Here the moving plane is established by the plane comprising the first and second contact areas in the off-status of the switch. The distance between the permanent magnets can be varied as a function of the applied magnetic material for the permanent magnets. To obtain a certain required magnetic field, the distance shall be smaller in case of magnetic materials with a weaker magnetic force and vice versa. The height of the permanent magnets is adapted to provide a magnetic field preferably being as close as possible to a homogeneous magnetic field between the arc-guiding elements. With a homogeneous magnetic field, an optimized moving behavior of the electric arc towards the arc-extinguishing units is achieved. To further increase the magnetic field for a certain magnetic material at a fixed distance between the permanent magnets, the second arc-guiding element between the permanent magnets being in contact to the permanent magnets serves as a back iron for the permanent magnets. To be able to guide the magnetic flux through the second arc-guiding element, at least the part of the second arc-guiding element arranged between the permanent magnets has to be made of magnetic permeable material. In alternative embodiment, the complete second arc-guiding element may be made of magnetic permeable material. The term "magnetic permeable" denotes all magnetic permeable materials regardless on the strength of its magnetic permeability. Suitable magnetic permeable materials are known by skilled people. Preferred materials are ferromagnetic materials such as Fe, Ni, Co or alloys comprising Fe, Co, Ni providing a high magnetic permeability. As an example, in a switch suitable for voltage of 1500 V-DC and a current of 30 A, the distance between oppositely arranged permanent magnets is about 8 mm. For devices intended to be used for higher currents, the distance between the oppositely arranged permanent magnets will increase. The contact between second arc-guiding element and the permanent magnets might be established by preferably attaching the permanent magnets to the second arc-guiding element fixed together by the magnetic forces or with any other suitable means chosen by skilled people within the scope of this invention (e.g. screwing, clamping, welding, soldering etc). In an embodiment the switch comprises 4 permanent magnets shaped as flat plates, which are arranged as two pairs of magnets each arranged oppositely covering the areas of the two pairs of first and second contact areas in order to provide an essentially homogeneous magnetic field essentially perpendicular to the direction of the current flow within the electric arc extending from the first to the second contact areas.

The switch as claimed in the present invention enables to extinguish electric arcs after a short time period, because the strong magnetic field applied to the electric arc will drive the electric arc faster into the arc-extinguishing units as would be the case in prior art devices. Furthermore, the first arc-guiding element directly contacted to the first contact areas will avoid any hampering barriers such as air gaps for the movement of the electric arc towards the arc-extinguishing units. The arrangement of permanent magnets close to the first and second contact areas enables the use of smaller and therefore cheaper magnetic materials. The layout of the switch according to the present invention enables to use only permanent magnets for providing a switch with fast and reliable extinguishing of electric arcs. The extinguishing of arcs is furthermore achieved in a predictable manner due to the use of permanent magnets providing a defined known magnetic field to any electric arc.

In another embodiment the permanent magnets are reversibly mounted to the second arc-guiding element. This enables the use of these second arc-guiding elements also for other applications such as AC applications, where permanent magnets are not required. The permanent magnets can easily removed or replaced by slot motors as commonly used in AC switches instead of permanent magnets. The term slot motor denotes metal plates, which are arranged similar to the permanent magnets, but are not permanently magnetized. The slot motors shall support the switching forces to the movable bridge in case of AC switches.

In another embodiment the permeable material of the second arc-guiding element comprises a cladding; preferably the permeable material is cladded iron. The cladding enables to wrap the second arc-guiding element with a material providing sufficient electrical properties and/or resistance properties against environmental influences. In a preferred embodiment the cladding is made of a material providing a corrosion protection, e.g. nickel cladded iron.

In another embodiment the switch comprises one suitable shaped second arc-guiding element extending from one arc-extinguishing unit to the other arc-extinguishing unit. A single second arc-guiding element enables a faster and more reliable mounting of the switch, because the single second arc-guiding element is may be used as a back plate to fix the movable bridge and the permanent magnets required for the two separate first and second contacts areas can be aligned more accurately relative to each other. In a preferred embodiment the shape of the second arc-guiding element comprises a recess suitable to accommodate the movable bridge in the off-status. This recess enables a smooth movement of the electric arc from the second contact areas located on the bridge to the second arc-guiding element leading to an even faster extinguishing of the electric arc. The term "recess" denotes all kind of cavities, where the second arc-guiding plate is arranged in a larger distance to the first contact areas in the area opposite the first contact area compared to the distance of the second arc-guiding plate adjacent to this recess area. The profile of the shape of the second arc-guiding plate in the area opposite to the first contact areas might be a U-shaped profile with a base area and side wall areas. Preferably the side wall areas have a height, which is adapted to equal the height level of the surface of movable bridge facing towards the first contact areas in the off-status.

In another embodiment the shape of the second arc-guiding element is adapted to be applicable simultaneously in switches comprising slot motors instead of permanent magnets. Therefore the same second arc-guiding element has to comprise means enabling the mounting of both, permanent motors and slot motors. As an example, such means might be protrusions, where the permanent magnets can be placed on (and fixed to the second arc-guiding element by the magnetic force) and the slot motors might be clamped on. This enables a use of the same second arc-guiding in DC switches and AC switches on demand requiring only one production machine to manufacture second arc-guiding plates for different types of applications resulting in decreased manufacturing costs.

In another embodiment the second arc-guiding element comprises a tapered area to guide the electric arc apart from the permanent magnets extending from a point adjacent to the second contact areas of the movable bridge in the off-status towards the arc-extinguishing units. Without any guiding the electric arc might get into contact to the sidewalls of the switch, especially might get into contact to the permanent magnets eventually causing a damage of the permanent magnets of a demagnetizing of the permanent magnets, which would hamper the arc-extinguishing of further electric arcs. Therefore, preventing the electric arcs to contact sidewalls and/or the permanent magnets is advantageous. In a preferred embodiment the tapered area extends into the arc-extinguishing unit to prevent any contact to the permanent magnets or even the outer edges of the magnets extending close to the arc-extinguishing units. The magnetic field is at least essentially homogeneous between the permanent magnets apart from the edges of the permanent magnets. However at the edges of the permanent magnets the lines of magnetic flux are not parallel aligned any more leading to an at least significantly weakened magnetic force on the electric arc in direction to the arc-extinguishing units. If the electric arc is allowed to come close to these edges, the electric arc might be pinned to the edges. Therefore it is further advantageous for a fast extinguishing of the electric arc to extend the tapered areas into the arc-extinguishing units. The shape of the tapered areas might vary as a function of the shape of the switch, the permanent magnets and the arc-extinguishing units. The tapered areas might be provided as small bridges between areas with a larger width, e.g. the areas of the second arc-guiding element close to the movable bridge and within the arc-extinguishing units. The minimum width of the bridge depends on the required current loadability of the bridge resulting from the operation conditions of the switch and the correspondingly expected electric arcs. Skilled people are able to derive required current loadability and the corresponding minimum width of the bridge from the known material properties and the known operating conditions of the switch. The thickness of the bridge could be the same thickness of other parts of the second arc-guiding element. The upper surface of the bridge might be arranged as a flat surface. However it is preferred to use a bridge with an upper surface having a curved contour providing an elevation in the middle of the bridge. The electric arc will follow always the path with the smallest distance to the first arc-guiding element, which is defined by the path of the elevated area of the bridge. Therefore an elevation in the middle of the bridge further improves the guiding of the electric arc towards the arc-extinguishing units and will further reduce the risk of electric arcs coming in contact to other parts of the switch outside the arc-extinguishing units. As an example, in case of tapered areas provided as bridges, the width of these bridges might by 3-4 mm and the width of the curved contour in the middle of the bridge might be 1 mm. The height of the contour relative to a corresponding flat surface could be in the order of 1 mm.

In another embodiment the switch further comprises at least one cover unit, preferably made of an electrical insulating material, more preferably a plastic material, to cover at least parts of at least one of the permanent magnets. The cover unit will further protect the permanent magnets from getting into contact with the electric arc avoiding any damage and/or any demagnetizing effect by induced heat to the permanent magnets, which would hamper the arc-extinguishing of further electric arcs. The cover further prevents any electrical contact between the permanent magnets and the first contact and/or the first arc-guiding element. The application of cover units could be used in combination with second arc-guiding element comprising tapered areas or with second arc-guiding element not comprising tapered areas. The cover unit will provide sufficient protection for the permanent magnets making tapered areas within the second arc-guiding element only optional. A sufficiently shaped cover unit will also prevent the electric arc from being located to near to the edges of the permanent magnets in order to prevent any pinning of the electric arc on its way into the arc-extinguishing units. The material of the cover units should be electrical insulating, e.g. plastic.

In a preferred embodiment at least one cover unit comprises at least one cavity adapted to the shape of at least one of the permanent magnets to be imposed on the permanent magnets, preferably in a snug fit manner. The cover unit for the permanent magnet supports the fixation of the permanent magnets to the second arc-guiding element. The permanent magnets can be simply connected to the second arc-guiding element by attaching the permanent magnets on top or to the sides of the second arc-guiding element. The fixation of the permanent magnets in its desired position to provide an essentially homogeneous magnetic field between oppositely arranged permanent magnets is maintained by the cover unit with the corresponding oppositely arranged cavities holding the permanent magnets in its position. The cover unit might be mounted to other components of the switch by any suitable means (snug fit, screwed, clamped etc.) in order to be fixed.

In a preferred embodiment only one single cover unit comprises cavities to accommodate all the permanent magnets suitably shaped to connect the second arc-guiding element via the magnetic force to the permanent magnets in present in the cavities of the cover unit. The cavities might be shaped as open pockets, where the permanent magnets can be contacted to the second arc-guiding element.

In another embodiment the shape of the cover unit and/or the shape of the cavities of the cover unit are adapted to be applicable simultaneously in switches comprising slot motors instead of permanent magnets. Here the cavities have to be formed to be able to accommodate both permanent magnets and slot motors on demand. This enables the use of the same cover units in DC switches and AC switches on demand requiring only one production machine to manufacture cover units for different types of applications resulting in decreased manufacturing costs.

FIG. 1 shows an embodiment of the switch 1 suitable for DC applications according to the present invention in a side view. The switch 1 comprises two fixed conductive contacts 2 with curved shapes having two first contact areas 21, 22, the one first contact area 21 on the left fixed contact and the other first contact area 22 on the right conductive contact 2 facing towards a movable conductive bridge 3 with two second contact areas 31, 32 facing towards the corresponding first contact areas 21, 22. The switch 1 is shown here for example in the off-status, where the two second contact areas 31, 32 are disconnected from two the first contact areas 21, 22. In the previous on-status, there was a current I flowing between the left first contact area 21 to the right first contact area 22 via the conductive bridge 3 being in contact with the fixed contacts 2. During the removal of the bridge 3 from the first fixed contacts 2, electric arcs 51, 52 occurred between each of the first and second contact areas 21, 22, 31, 32. In order to eliminate (extinguish) the electric arcs 51, 52, two arc-extinguishing units 41, 42 are connected to the first and second contact areas 21, 22, 31, 32 via first conductive arc-guiding elements 61 extending from each first contact area 21, 22 into the corresponding arc-extinguishing unit 41, 42 and at least one second conductive arc-guiding element 62 which extends into the arc-extinguishing units 41, 42 having a suitable shape to guide the electric arcs 51, 52 from each of the second contact areas 31, 32 of the movable bridge 3 into the arc-extinguishing units 41, 42. The electric arcs 51, 52 will be extinguished inside the arc-extinguishing units 41, 42 by utilizing multiple arc-splitters 8 (in this example there are eight arc-splitters) arranged in parallel between the first and second arc-guiding elements 61, 62. The presence of the arc-splitters lead to a split-up of the original electric arc 51 into several sub-arcs inside the left arc-extinguishing unit 41 resulting in a required voltage to maintain the electric arc exceeding the voltage provided by the switch. Subsequently the arc will be extinguished. The numbers of arc-splitters and the applied voltage is only one example. For other operation voltages, the set-up of the arc-extinguishing units has to be adapted. A fast extinguishing of an electric arc 51, 52 requires a force driving the arc from the first and second contact areas 21, 22, 31, 32 into the arc-extinguishing units 41, 42. This force will be provided by two pairs of permanent magnets 71, 72, where the two permanent magnets of each pair of permanent magnets 71, 72 are arranged oppositely adjacent to each of the first and second contact areas 21, 22, 31, 32 and are aligned in parallel in order to provide a homogeneous magnetic field to the electric arcs 51, 52. The direction of the current flow is indicated by the dashed arrows I. Depending on the direction of the current flow in a particular switch, the direction of the magnetic field has to be chosen properly in order to obtain a force F acting on the electric arcs 51, 52 with a direction facing towards the arc-extinguishing units 41 and 42. Since the first arc-guiding elements 61 are connected to the first contact areas 21, 22, the electric arc can move along the first arc-guiding element 61 towards the arc-extinguishing units 41, 42. The movable bridge will be guided during the movement in order to open and close the bridge along a guiding 33. The shown guiding 33 is only one possible example of suitable guiding for the movable bridge 3. The guiding of the bridge 3 enables to arrange the second arc-guiding element 62 close (indicate as "P" in FIG. 1) to the bridge 3 to enable the electric arc 51, 52 to be transferred from the bridge 3 to the second arc-guiding element 62 easily. To obtain a smooth transition of the electric arc to the second arc-guiding element 62, the position of the movable bridges during the off-status is inside a recess 623 of the second arc-guiding element 62 adapted to the shape of the movable bridge 3. In the example shown in FIG. 1, the second arc-guiding element 62 is provided as a single element. In other embodiments, the second arc-guiding element 62 may consist of two or more separate parts. However, the stronger the force onto the electric arcs 51, 52, the faster the extinguishing can be achieved. Therefore the pairs of permanent magnets 71, 72 are connected by parts 621, 622 of the second arc-guiding element 62 made of magnetic permeable material to establish a back iron for each of the pairs of permanent magnets 71 and 72. In the side view, only one of the pairs of permanent magnets 71, 72 is shown for ease of understanding. The permanent magnets are shaped as thin plates extending from the contact areas to the arc-extinguishing units 41, 42 to provide a magnetic field, which is as close as possible to a homogeneous magnetic field. The upper contour of the plates (facing towards the first arc guiding element 61) follows the widened distance between first and second arc-guiding elements 61, 62. However, the permanent magnets have to be sufficiently shaped and/or mounted in order to be electrically insulated against the fixed first contact 2, e.g. with an air gap between upper contour and first contacts 2 and first arc-guiding elements 61. The lower contour extends partly below the second arc-guiding element 62 in order to provide the strongest homogeneous magnetic field possible with this set-up to the electric arcs 51, 52. In this example, the second arc-guiding element is made of nickel cladded iron to further provide a corrosion protection at the surface of the second arc-guiding element 62. The tapered areas 624 to properly guide the electric arcs 51, 52 apart from the permanent magnets 71, 72 are shown only schematic, a better view is provided in FIGS. 2 and 3.

Figure 2:
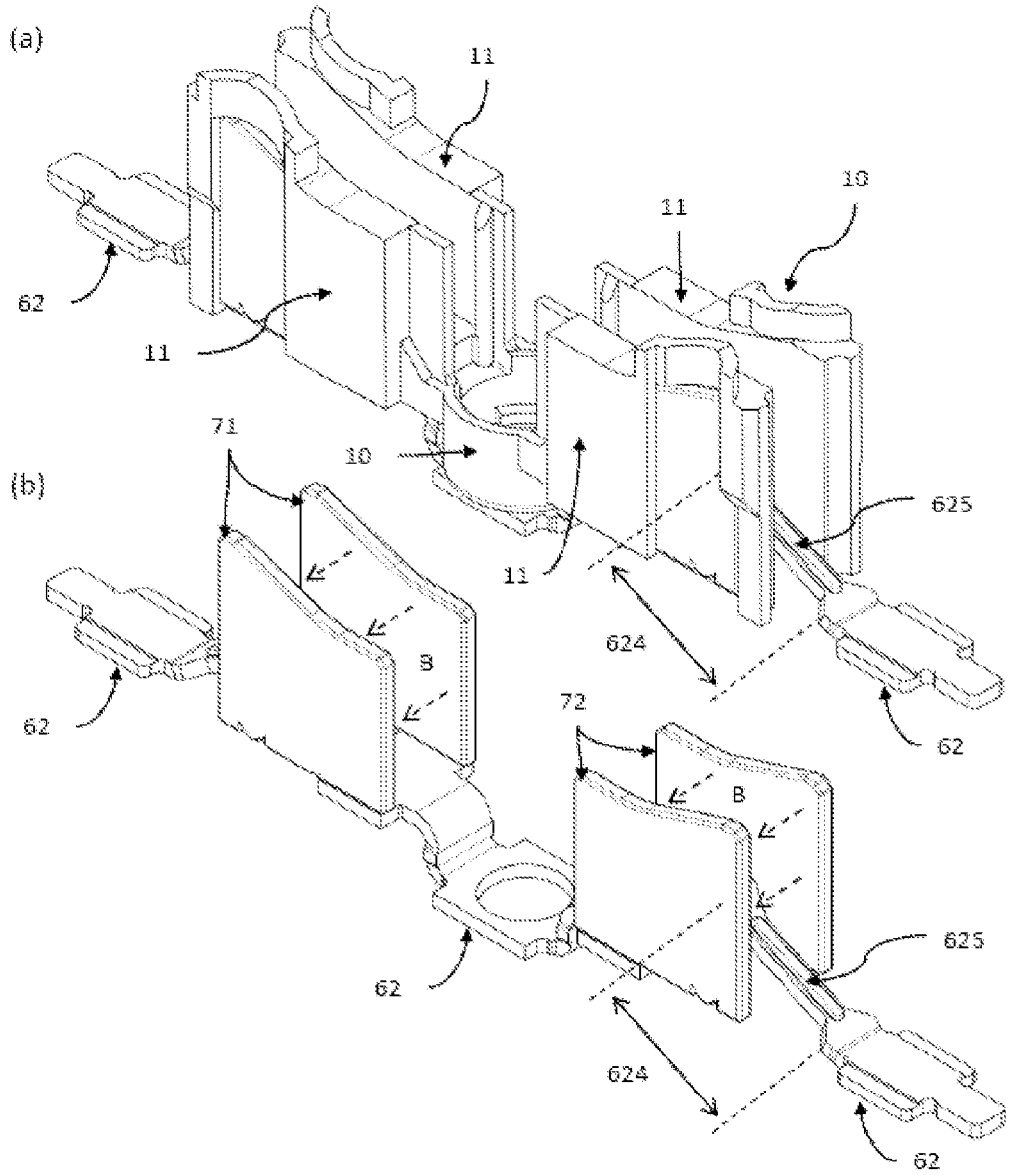
FIG. 2: a perspective view of an embodiment of permanent magnets attached to the second arc-guiding element (a) covered by a cover unit, and (b) not covered.

FIG. 2 shows a perspective view of an embodiment of permanent magnets 71, 72 attached to the second arc-guiding element 62 (a) covered by a cover unit 10, and (b) not covered. In this embodiment four permanent magnets 71, 72 are arranged as two pairs of two permanent magnets each, see part (b) of FIG. 2. The homogeneous magnetic field and its direction provided by each pair of permanent magnets 71, 72 is indicated by the parallel dashed arrows B. In other embodiments, the number of permanent magnets arranged oppositely may vary within the scope of this invention. The cover 10 as shown in part (a) of FIG. 2 as a single piece cover 10, e.g. made of plastic and manufactured with injection molding, comprises four cavities 11 which inner shape adapted to accommodate the four permanent magnets 71, 72, preferably in a snug fit manner to simultaneously hold the magnets in the desired position. Skilled people may choose other fixation means to hold the permanent magnets inside the cavities within the scope of the present invention. The permanent magnets 71, 72 may be mounted to the second arc-guiding element 62 by firstly inserting the permanent magnets 71, 72 into the cavities 11 having an open end and secondly attaching the arc-guiding element 62 (at least partly made of a magnetic permeable material) to the lower side of the permanent magnets 71, 72 slightly protruding outside the cavities 11 in order to face towards the second arc-guiding element 62. With this mounting method, no further fixations are needed to mount the permanent magnets 71, 72 to the second arc-guiding element 62. The cover 10 may be additionally fixed to the second arc-guiding element 62 or to the other components of the switch with the central part of the cover 10 providing a hole for further guiding of the movable bridge (not shown here). In an alternative embodiment, there may only one large permanent magnet arranged on each side of the first and second contact areas extending from the one arc-extinguishing element 41 to the other arc-extinguishing element 42. Subsequently, the cover 10 would be adapted correspondingly to the applied number and shape of the permanent magnets 71, 72. The tapered areas 624 of the second arc-guiding element 62 are shown in more detail. The tapered areas 624 will guide the electric arcs in the middle between the permanent magnets 71, 72 to prevent any contact to the permanent magnets 71, 72 and to maintain a large distance to the edges of the magnets when entering the arc-extinguishing units 41, 42 (not shown here). To further support the guiding of the electric arcs, the tapered areas 624 comprise an elevation 625, where the electric arc will run at the highest point of the elevation equaling the smallest distance between first and second arc-guiding elements 61, 62.

Figure 3:
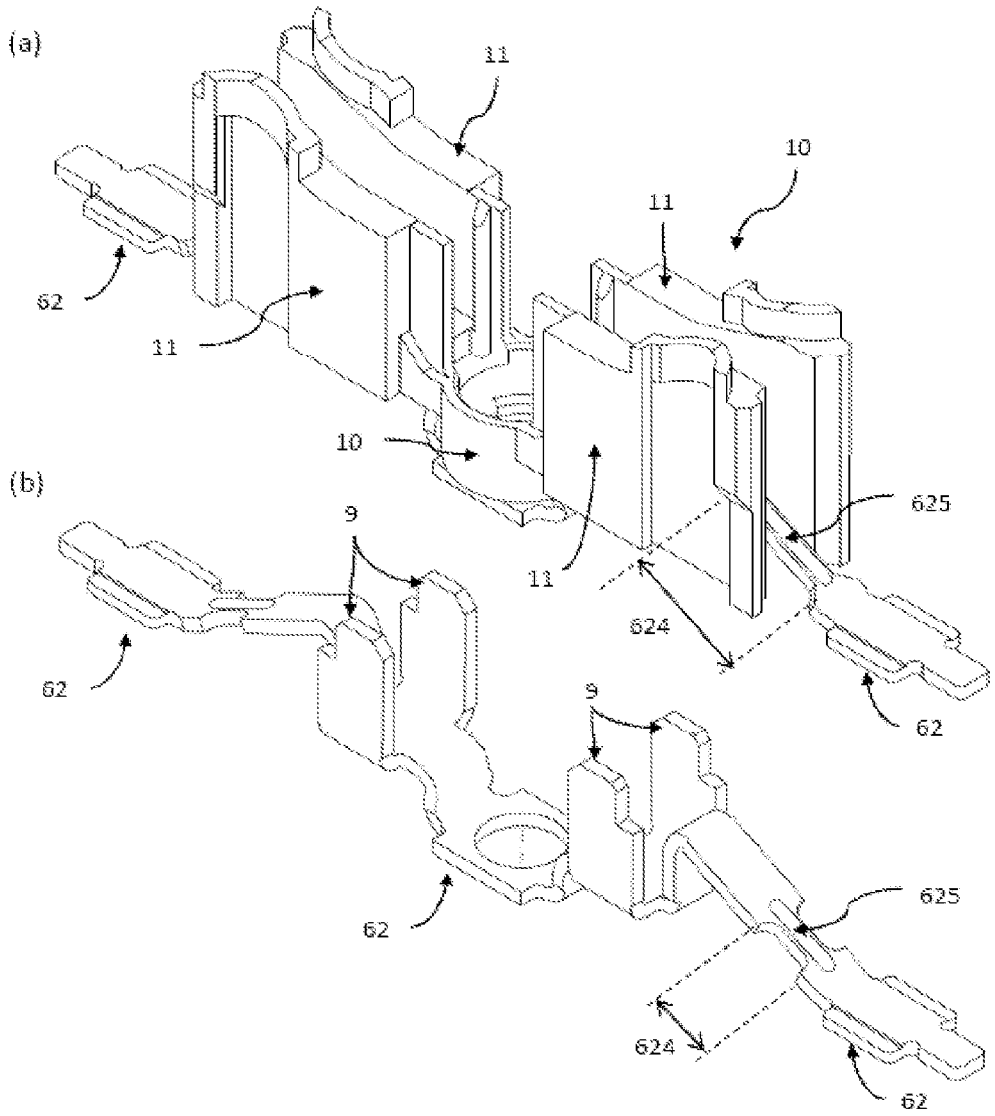
FIG. 3: a perspective view of the second arc-guiding element of FIG. 2 with attached slot motors, where (a) the slot motors are covered by the cover unit shown in FIG. 2, and (b) not covered.

FIG. 3 shows a perspective view of the second arc-guiding element 62 of FIG. 2 with attached slot motors 9, where (a) the slot motors 9 are covered by the cover unit 10 shown in FIG. 2, and (b) not covered. Here the permanent magnets are replaced by slot motors either fixed to the second arc-guiding element 62 directly or fixed inside the cavities 11 of the cover 10, where the cover 10 is mounted to the second arc-guiding element 62 with the central part as previously discussed for FIG. 2. Part (as) of FIG. 2 comprises a different embodiment of the tapered areas 624 to demonstrate the possibility to vary the shape of the tapered area 624 within the scope of this invention.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

LIST OF REFERENCE

1 switch according to the present invention
2 fixed conductive contacts

21, 22 first contact areas
3 movable conductive bridge
31, 32 second contact areas
33 guiding for the movable bridge
41, 42 arc-extinguishing areas
51, 52 electric arcs
61 first arc-guiding element
62 second arc-guising element
621, 622 parts of second arc-guiding element made of magnetic permeable material
623 recess to accommodate the movable bridge in the off-status of the switch
624 tapered area of the second arc-guiding element
625 elevation within the tapered area
71, 72 permanent magnets
8 arc-splitters
9 slot motors
10 cover to cover the permanent magnets at least partly
11 cavities in the cover to accommodate the permanent magnets
B magnetic field provided by the permanent magnets
I direction of current flow
F Lorenz force applied to the electric arc
P point within the second arc-guiding element adjacent to the second contact areas of the movable bridge

The invention claimed is:

1. A switch suitable for DC applications, comprising:
two fixed conductive contacts with first contact areas;
a movable conductive bridge with two second contact areas for being connected to the two first contact areas in the on-status and for being disconnected from the two the first contact areas in the off-status; and
two arc-extinguishing units configured to extinguish electric arcs occurring between the first and second contact areas after disconnecting the second contact areas from the first contact areas;
wherein first conductive arc-guiding elements extend from each first contact area into the corresponding arc-extinguishing unit and at least one second conductive arc-guiding element extends into the arc-extinguishing units suitably shaped to guide the electric arcs from each of the second contact areas of the movable bridge into the arc-extinguishing units:
wherein at least two permanent magnets are suitably arranged adjacent to the first and second contact areas to provide a magnetic field suitable to support the guiding of the electric arc into the arc-extinguishing units; and
wherein at least parts of the second arc-guiding element are made of a magnetic permeable material, which are connected to the permanent magnets as a back iron for the permanent magnets to increase the strength of the magnetic field between the permanent magnets.

2. The switch according to claim 1, wherein the permanent magnets are shaped as elements extending essentially parallel to the moving plane of the movable bridge.

3. The switch according to claim 2, wherein the arc-extinguishing units comprise multiple arc-splitters between the first and second arc-guiding elements arranged parallel to each other, where the permanent magnets extend close to the arc-splitters.

4. The switch according to claim 1, wherein the permanent magnets are reversibly mounted to the second arc-guiding element.

5. The switch according to claim 1, wherein the permeable material comprises a cladding.

6. The switch according to claim 5, wherein the permeable material is cladded iron.

7. The switch according to claim 5, wherein the cladding is made of a material providing a corrosion protection.

8. The switch according to claim 1, wherein one suitable shaped second arc-guiding clement extends from one arc-extinguishing unit to the other arc-extinguishing unit.

9. The switch according to claim 8, wherein the shape of the second arc-guiding element comprises a recess suitable to accommodate the movable bridge in the off-status.

10. The switch according to claim 8, wherein the shape of the second arc-guiding element is adapted to be applicable simultaneously in switches comprising slot motors instead of permanent magnets.

11. The switch according to claim 1, wherein the second are-guiding element comprises a tapered area to guide the electric arc apart from the permanent magnets extending from a point adjacent to the second contact areas of the movable bridge in the off-status towards the arc-extinguishing units.

12. The switch according to claim 11, wherein the tapered area extends into the arc-extinguishing unit.

13. The switch according to claim 1, wherein the switch further comprises at least one cover unit to cover at least parts of at least one of the permanent magnets.

14. The switch according to claim 13, wherein the at least one cover unit is made of an electrical insulating material.

15. The switch according to claim 14, wherein the electrical insulating material is a plastic material.

16. The switch according to claim 13, wherein the at least one cover unit comprises at least one cavity adapted to the shape of at least one of the permanent magnets to be imposed on the permanent magnets.

17. The switch according to claim 16, wherein the at least one cavity is adapted to the shape of at least one of the permanent magnets in a snug fit manner.

18. The switch according to claim 16, wherein a single cover unit comprises cavities to accommodate all the permanent magnets suitably shaped to connect the second arc-guiding element via the magnetic force to the permanent magnets present in the cavities of the cover unit.

19. The switch according to claim 13, wherein at least one of the shape of the cover unit and the shape of the cavities of the cover unit are adapted to be applicable simultaneously in switches comprising slot motors instead of permanent magnets.

* * * * *